US007308218B2

(12) United States Patent
Roof et al.

(10) Patent No.: US 7,308,218 B2
(45) Date of Patent: Dec. 11, 2007

(54) WARM-UP OF MULTIPLE INTEGRATED MARKING ENGINES

(75) Inventors: Bryan J. Roof, Fairport, NY (US); Donald M. Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 75 days.

(21) Appl. No.: 11/152,275

(22) Filed: Jun. 14, 2005

(65) Prior Publication Data

US 2006/0280517 A1 Dec. 14, 2006

(51) Int. Cl.
*G03G 15/00* (2006.01)

(52) U.S. Cl. ..... 399/88; 399/67; 399/70

(58) Field of Classification Search ..... 399/110, 399/112, 115, 123, 88; 347/192
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |
| 5,778,377 | A | 7/1998 | Marlin et al. |
| 5,884,910 | A | 3/1999 | Mandel |
| 5,995,721 | A | 11/1999 | Rourke et al. |
| 6,059,284 | A | 5/2000 | Wolf et al. |
| 6,125,248 | A | 9/2000 | Moser |
| 6,241,242 | B1 | 6/2001 | Munro |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M. Gray
*Assistant Examiner*—David A Blackshire
(74) *Attorney, Agent, or Firm*—Eugene O. Palazzo; Fay Sharpe LLP

(57) ABSTRACT

A printing device includes: multiple marking engines that during operation place marks on output media; and, a power supply that selectively supplies selected levels of power to the marking engines for selected times so as to ready the marking engines for operation from a dormant state. Power from the power supply is selectively distributed to the multiple marking engines so that at least one of the marking engines is readied for operation prior to at least one of the other marking engines.

12 Claims, 3 Drawing Sheets

U.S. PATENT DOCUMENTS

| | | | | |
|---|---|---|---|---|
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0039026 | A1* | 2/2006 | Lofthus et al. | 358/1.15 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 24, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.

* cited by examiner

WARM-UP OF MULTIPLE INTEGRATED MARKING ENGINES

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled "IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P application Ser. No. 11/137,273, filed May 25, 2005, entitled "PRINTING SYSTEM", by David G. Anderson et al.;

U.S. application Ser. No. 11/143,818, filed Jun. 2, 2005, entitled "INTER-SEPARATION DECORRELATOR", by Edul N. Dalal et al.; and, U.S. application Ser. No. 11/146,665, filed Jun. 7, 2005, entitled "LOW COST ADJUSTMENT METHOD FOR PRINTING SYSTEMS", by Michael C. Mongeon.

BACKGROUND

The present disclosure relates to warming-up a printing device or machine having multiple Integrated Marking Engines (IMEs). It finds particular application in conjunction with xerographic devices or machines, and will be described with particular reference thereto. However, one of ordinary skill in the art will appreciate that it is also amenable to other like applications.

Printing devices are known to include multiple IMEs. For example, printing devices are known which include two or more IMEs. Typically, before such printing devices begin printing, each IME therein is warmed-up. The IME warm-up commonly occurs during the initial powering-up or turning-on of the printing device, or when the printing device is awoken from a sleep, stand-by or other like power conservation mode. IME warm-up generally includes supplying electrical power to the IME for a period of time, e.g., to bring a fuser and/or other components of the IME from a lower ambient temperature up to a target operating temperature or otherwise prepare the IME for operation. Once the warm-up is completed, the power supplied to the IME is typically reduced from a warm-up level to a lower operating level.

Conventionally, all the IMEs within the printing device are warmed-up simultaneously. Accordingly, the total power available to the device for IME warm-up is divided across all of the IMEs in the device. Depending on various factors, e.g., the thermal mass of the individual fusers and the total available power for IME warm-up, the warm-up time for the printing device can be undesirably long. Moreover, the simultaneous warm-up of multiple IMEs within a printing device can negatively impact a first-page-out-time (FPOT) of the printing device, i.e., the time it takes for the printing device in a given instance to provide or output the first copied or printed page of an input job. Generally, a long FPOT can result in dissatisfaction to the user.

Accordingly, a new and improved multiple IME printing device and/or method for warming-up multiple IMEs within a printing device are disclosed that overcome the above-referenced problems and others.

BRIEF DESCRIPTION

Aspects of the present disclosure, in embodiments thereof, include a printing device having: multiple marking engines that during operation place marks on output media; and, a power supply that selectively supplies selected levels of power to the marking engines for selected times so as to ready the marking engines for operation from a dormant state. Suitably, power from the power supply is selectively distributed to the multiple marking engines so that at least one of the marking engines is readied for operation prior to at least one of the other marking engines.

Aspects of the present disclosure, in embodiments thereof, include a xerographic imaging device having: a first integrated marking engine, the first integrated marking engine selectively putting marks on an output media during its operation; a second integrated marking engine, the second integrated marking engine selectively putting marks on an output media during its operation; and, a power supply that selectively supplies selected levels of electrical power to the first and second integrated marking engines so as to get them ready for operation from a dormant state and to power their operation. Suitably, power from the power supply is selectively distributed to the first and second integrated marking engines so that the first integrated marking engine is readied for operation prior to the second integrated marking engine being readied for operation.

Aspects of the present disclosure, in embodiments thereof, include a printing device including: a first marking engine, the first marking engine selectively marking an output media during its operation and having a warm-up period associated therewith in which the first marking engine is prepared for operation; a second marking engine, the second marking engine selectively marking an output media during its operation and having a warm-up period associated therewith in which the second marking engine is prepared for operation; and, a power supply that selectively supplies electrical power to the first and second marking engines, the power supply providing warm-up power to the marking engines during their respective warm-up periods to prepare them for operation, and providing operating power to the marking engines to power their operation. Suitably, power from the power supply is selectively distributed to the first and second marking engines so that the first marking engine completes is warm-up period sooner than the second marking engine completing its warm-up period.

Numerous benefits of the subject matter disclosed herein will become apparent to those of ordinary skill in the art upon reading and understanding the present specification.

BRIEF DESCRIPTION OF THE DRAWINGS

The subject matter of the present disclosure may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION

Figure 1:
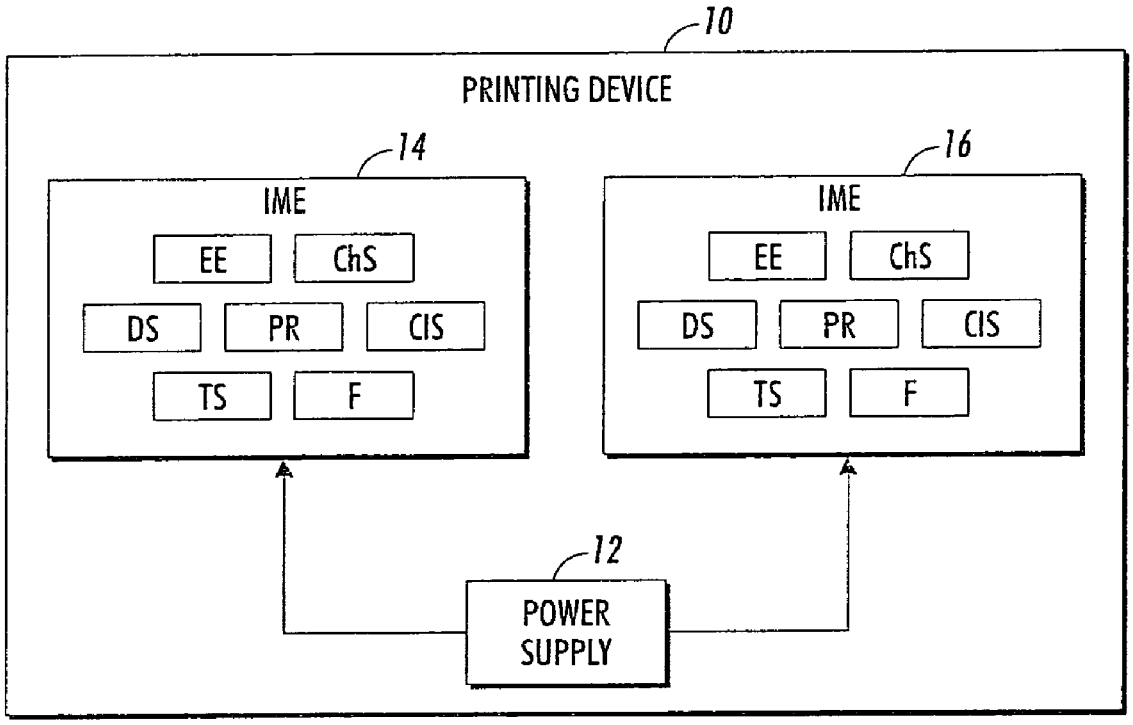
FIG. 1 is diagrammatic illustration showing an example embodiment of a multiple IME printing device.

With reference to FIG. 1, an imaging and/or printing device 10 includes multiple IMEs and a power supply 12. As illustrated, the printing device 10 includes two IMEs, namely, a first IME 14 and a second IME 16. While only two IMEs are shown for simplicity and clarity herein, optionally, the printing device 10 may include more than two IMEs. Suitably, the printing device 10 is a copier, printer, a facsimile machine, a multi-function device or other like imaging and/or printing device, and the IMEs are implemented as xerographic or other like electrostatic imaging and/or printing modules that image, print or otherwise place marks on an output media, such as a sheet of paper. Each IME is suitably equipped in the usual manner, e.g., with a photoreceptor (PR), a fuser (F), a charging station (ChS), exposing equipment (EE), a developing station (DS), a transferring station (TS), and a cleaning station (CIS). Alternately, the multiple IMEs may be implemented in any customary manner. For example, in one alternate embodiment, the printing device 10 is a solid ink printing device in which the IMEs 14 and 16 are optionally implemented as print-heads and/or solid ink printing modules which use melted solid ink to selectively place marks on an output media.

In the illustrated embodiment, the power supply 12 selectively supplies electrical power to both the first and second IMEs 14 and 16. Prior to operation of the individual IMEs, each IME is warmed-up, e.g., by the power supply 12 supplying a selected level of power thereto (referred to as the warm-up power level) for a selected period of time (referred to the warm-up time). Warming-up the IME raises its fuser and/or other selected components from a lower ambient temperature up to a target operating temperature or otherwise prepares the IME for operation from a dormant or non-operationally ready state. For example, in a solid ink embodiment, warming-up the IMEs relates to raising the temperature of their print-heads and/or other heating elements so as to be suitable for melting and/or otherwise flowing the solid ink used thereby. Suitably, IME warm-up occurs during the initial powering-up or turning-on of the printing device 10, or when the printing device 10 is awoken from a sleep, stand-by or other like power conservation mode. Once a particular IME has been warmed-up, the power supply 12 selectively drops the power level supplied thereto down from the warm-up power level to a selected lower level (referred to as the operating power level).

In one embodiment, all the IMEs in the printing device 10 are not warmed-up simultaneously or otherwise brought concurrently to their operational states. Rather, power is selectively distributed from the power supply 12 to the various IMEs in the printing device 10 so as to ready at least one IME for operation prior to at least one other IME. Suitably, the FPOT of the printing device 10 is in this manner reduced from what it would otherwise be if all the IMEs in the printing device 10 were warmed-up simultaneously or otherwise brought concurrently to their operational states.

Figure 2:
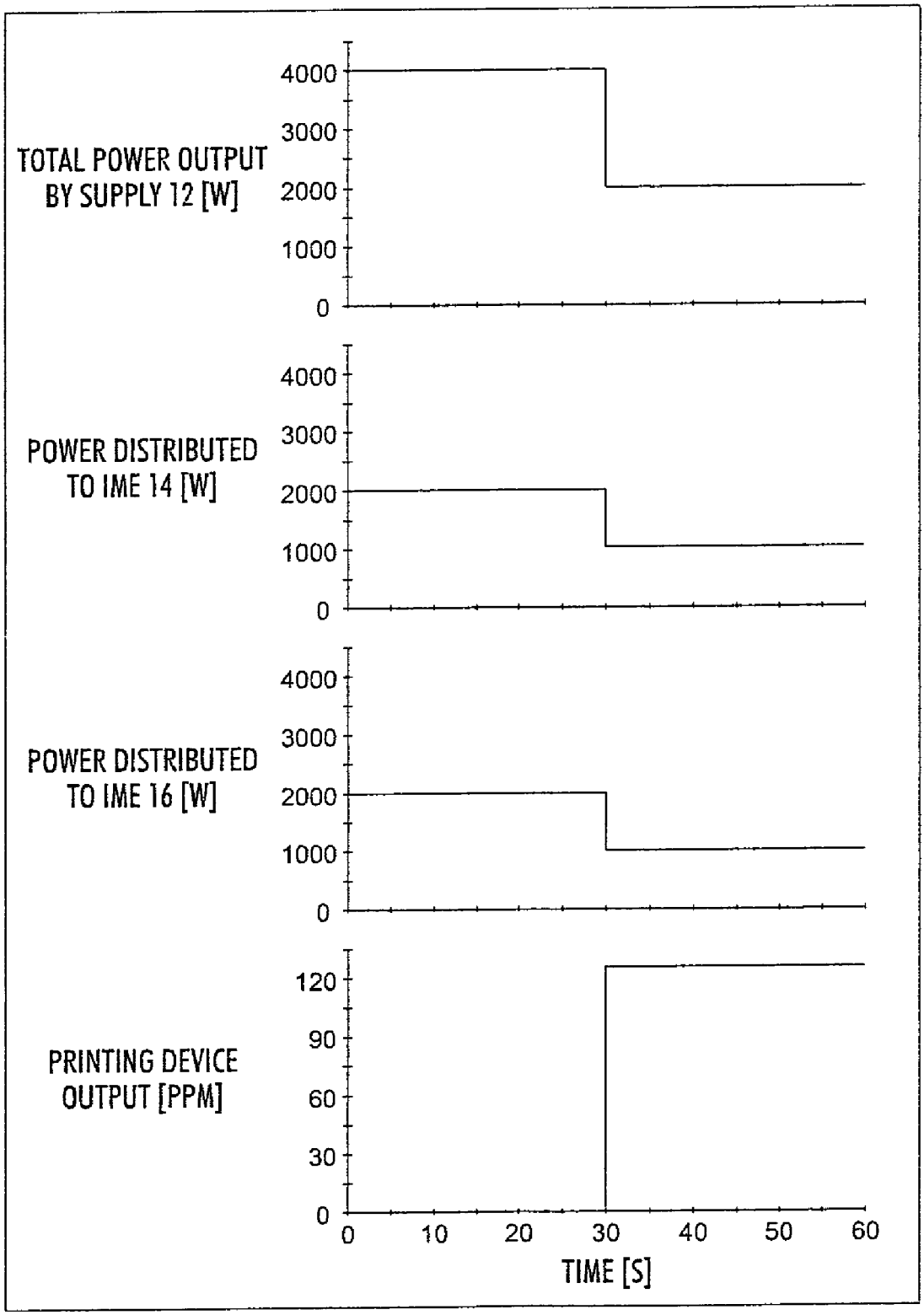
FIG. 2 is a graph showing a prior art power distribution scheme and corresponding output capacity for a multiple IME printing device; and, FIG. 3 is a graph showing an example power distribution scheme and corresponding output capacity for a multiple IME printing device.
Figure 3:
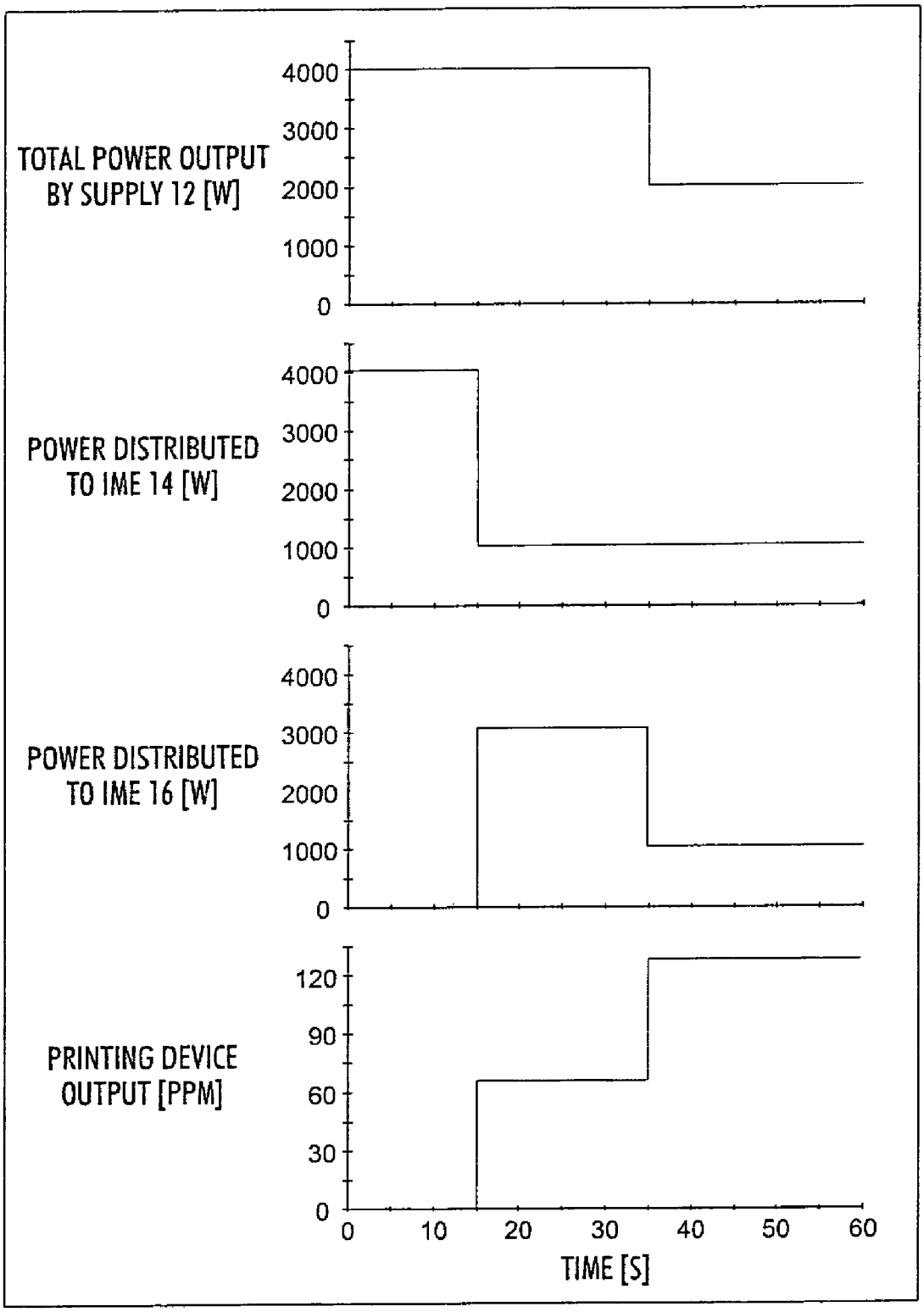

FIGS. 2 and 3 provide contrasting examples of power distribution schemes for use in a multiple IME printing device, such as the one illustrated in FIG. 1. For purposes of these examples, the IMEs 14 and 16 are considered substantially similar with respect to power consumption and output speed, however, this does not have to be the case. That is to say, optionally, the different IMEs included in the printing device 10 optionally have different power consumptions and/or output speeds.

FIG. 2 shows a power distribution scheme that simultaneously warms-up or otherwise brings both the IMEs 14 and 16 concurrently to their operational states from dormant states. On the other hand, FIG. 3 shows a power distribution scheme that sequentially warms-up of the IMEs 14 and 16, i.e., where the first IME 14 is warmed-up or otherwise brought to its operationally ready state from a dormant state prior to the second IME 16 achieving operational readiness. Suitably, each IME has or is characterized by: an output speed (OS) which can be measured, e.g., in pages per minute (ppm); an operational power level (OPL); a nominal warm-up power level (NWUPL); and a nominal warm-up time (NWUT), which is the warm-up time for the IME when powered at the nominal warm-up power level. For purposes of this example, the OS of each IME is assumed to be about 65 ppm, the OPL is assumed to be about 1000 watts (W), the NWUPL is assumed to be about 2000 W; and the NWUT is assumed to be about 30 seconds (s). Furthermore, it shall be assumed that the total power that can be output or supplied by the power supply 12 at any given point in time is set at about 4000 W.

With reference to FIG. 2, both IMEs 14 and 16 begin warming-up at time T=0. The total power output from the power supply 12 (i.e., about 4000 W) is distributed substantially equally to each IME. That is to say, the IME 14 receives about 2000 W and the IME 16 receives about 2000 W. The warm-up power level is about the same for both the IMEs 14 and 16, therefore, both the IMEs 14 and 16 are brought to operational readiness at about the same time. More specifically, as they are each receiving the NWUPL, both the IMEs 14 and 16 achieve operational readiness about 30 s later or at T=30, given the NWUT. At T=30 s (i.e., after both the IMEs 14 and 16 have completed warming-up), the power supplied by the power supply 12 to each IME is dropped to the OPL (i.e., about 1000 W). The printing device 10, at this point, has achieved its full operational productivity and/or capacity (i.e., about 130 ppm) insomuch as both IMEs are now warmed-up or otherwise operationally ready. However, the printing device 10 is not capable of outputting copied, printed or otherwise marked pages prior to this time insomuch as no IME is operationally ready at any earlier point in time.

With reference now to FIG. 3, only IME 14 begins warming-up at time T=0. The total power output from the power supply 12 (i.e., about 4000 W) is distributed entirely to the IME 14. That is to say, the IME 14 receives about 4000 W and the IME 16 receives about 0 W. As the IME 14 is receiving greater than the NWUPL, the warm-up time for the IME 14 is reduced relative to the NWUT. More specifically, as the IME 14 is receiving about twice the NWUPL, the IME 14 achieves operational readiness in about 15 s (i.e., in about half the NWUT), or at T=15 s. The printing device 10 is now capable of outputting copied, printed or otherwise marked pages insomuch as at least one IME is operationally ready. Accordingly, one of ordinary skill in the art will appreciate that the FPOT of the printing device 10 is reduced as compared to the example of FIG. 2, by as much as half or 15 s in this particular instance. However, the printing device 10, at this point, has only achieved about half its operational productivity and/or capacity (i.e., 65 ppm) insomuch as only one of the two IMEs is now warmed-up or otherwise operationally ready.

At T=15 s (i.e., after the IME 14 has completed warming-up), the power supplied by the power supply 12 to the IME 14 is dropped to the OPL (i.e., about 1000 W). This leaves a remainder of about 3000 W that the power supply 12 now applies or provides to the second IME 16. As the IME 16 is receiving power greater than the NWUPL, the warm-up time for the IME 16 is reduced relative to the NWUT. More specifically, as the IME 16 is receiving about ⅔ of the NWUPL, the IME 16 achieves operational readiness in about 20 s (i.e., in about ⅔ of the NWUT), or at T=35 s. Now that the IME 16 has completed warming-up, the power supplied by the power supply 12 to the IME 16 is also dropped to the OPL (i.e., about 1000 W). The printing device 10, at this point, has achieved its full operational productivity and/or capacity (i.e., about 130 ppm) insomuch as both IMEs are now warmed-up or otherwise operationally ready.

One of ordinary skill in the art will appreciate that the cost for improving the FPOT via sequential or non-simultaneous IME warm-up is a slight delay ($\Delta t$) in the time it take to achieve full productivity for the printing device 10. In the forgoing example, when FIG. 3 is compared to FIG. 2, the time to full productivity of the printing device 10 is merely extended by about 12.5%, or 5 s in this particular instance. This $\Delta t$ is maintained relatively low by having a substantial difference between the NWUPL and OPL of the IMEs 14 and 16. As the difference in these power levels increase, $\Delta t$ decreases, and vice versa. In the forgoing example, one of ordinary skill in the art will also appreciate that a total throughput of the printing device 10 (i.e., total pages output by the printing device 10 from the time T=0 s) is, for all times, greater in the example of FIG. 3 as compared to the example of FIG. 2.

Suitably, as illustrated in FIG. 3, each IME in the printing device 10 is warmed-up sequentially, with the next IME not beginning warm-up or otherwise receiving warm-up power from the supply 12 until the previous IME has completed warming-up. Alternately, the warm-up power is distributed to the various IMEs from the power supply 12 in staggered or overlapping time intervals. For example, the warm-up of a subsequent IME may begin prior to the preceding IME completing its warm-up. In other suitable embodiments, the IMEs in the printing device 10 may begin warming-up at the same time but at different rates. For example, the power distribution from the power supply 12 may favor one IME over another so that the former achieves operational readiness prior to the later. Alternately, the power distribution may be substantially equal to both IMEs, but the one IME may have a lower NWUPL or NWUT as compared to the other. Additionally, while FIG. 3 shows substantially constant or level power supplies being provided to the IMEs by the power supply 12 during their respective warm-ups, in alternate embodiments, the power provided to the IMEs by the power supply 12 during their respective warm-ups may vary over the warm-up time or take the shape of an arbitrary waveform, including, e.g., stepped, sloping, curving or other waveforms. In short, having read and understood the present specification, those of ordinary skill in the art will appreciate that a suitable power distribution scheme can be devised for a particular printing device having multiple IMEs to achieve a desired balance between the FPOT and the time it takes the printing device to reach its full productivity level by suitably distributing the supply of available power to the multiple IMEs within the printing device such that at least one of the IMEs is readied for operation prior to at least one of the other IMEs.

In the disclosed embodiments "at least one" refers, for example, to 1 or more than 1, and "multiple" or a "plurality" refers, for example, to 2 or more than 2.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic imaging device comprising:

a first integrated marking engine, said first integrated marking engine selectively putting marks on an output media during its operation;

a second integrated marking engine, said second integrated marking engine selectively pulling marks on an output media during its operation; and, a power supply that selectively supplies selected levels of electrical power to the first and second integrated marking engines so as to pet them ready for operation from a dormant state and to power their operation;

wherein power from the power supply is selectively distributed to the first and second integrated marking engines so that the first integrated marking engine is readied for operation prior to the second integrated marking engine being readied for operation;

wherein the cower supply produces an amount of power that is available for distribution to the first and second integrated marking engines to get them ready for operation and to power their operation; and, wherein initially substantially all of said amount of power is distributed to the first integrated marking engine to get it ready for operation, then after the first marking engine is ready for operation, a portion less than all of said amount of power is distributed to the first integrated marking engine to power its operation, and a remainder of said amount of power is distributed to the second integrated marking engine to get it ready for operation.

2. The xerographic imaging device of claim 1, wherein the first and second integrated marking engines are xerographic modules including fusers.

3. The xerographic imaging device of claim 2, wherein power supplied from the power supply to the first and second integrated marking engines to get them ready for operation from their dormant states is used by the first and second integrated marking engines to heat their fusers from an ambient temperature to an operating temperature, said operating temperature being higher than said ambient temperature.

4. The xerographic imaging device of claim 1, wherein the device is one of a copier, a printer, a facsimile machine or a multi-function device.

5. A printing device comprising:

a first marking engine, said first marking engine selectively marking an output media during its operation and having a warm-up period associated therewith in which the first marking engine is prepared for operation;

a second marking engine, said second marking engine selectively marking an output media during its operation and having a warm-up period associated therewith in which the second marking engine is prepared for operation; and, a power supply that selectively supplies electrical power to the first and second marking engines, said power supply providing warm-up power to the marking engines during their respective warm-up periods to prepare them for operation, and providing operating power to the marking engines to power their operation;

wherein power from the power supply is selectively distributed to the and second marking engines so that the first marking engine completes is warm-up period sooner than the second marking engine completing its warm-up period; and, wherein the warm-up power supplied to the first marking engine is higher than the warm-up power supplied to the second marking engine.

6. The printing device comprising:

a first marking engine, said first marking engine selectively marking an output media during its operation and having a warm-up period associated therewith in which the first marking engine is prepared for operation;

a second marking engine, said second marking engine selectively marking an output media during its operation and having a warm-up period associated therewith in which the second marking engine is prepared for operation; and, a power supply that selectively supplies electrical power to the first and second marking engines, said cower supply providing warm-up cower to the marking engines during their respective warm-up periods to prepare them for operation, and providing operating power to the marking engines to power their operation;

wherein power from the power supply is selectively distributed to the and second marking engines so that the first marking engine completes is warm-up period sooner than the second marking engine completing its warm-up period; and, wherein the warm-up powers supplied to the first and second marking engines are higher than the respective operating powers supplied thereto.

7. The printing device of claim 6, wherein warm-up power is not supplied to the second marking engine until the first marking engine completes its warm-up period.

8. The printing device of claim 6, wherein the power is distributed such that for a time the first marking engine is receiving operating power while the second marking is receiving warm-up power.

9. The printing device of claim 6, wherein the warm-up period for the second marking engine begins after a beginning of the warm-up period for the first marking engine.

10. A printing device comprising:

a first marking engine, said first marking engine selectively marking an output media during its operation and having a warm-up period associated therewith in which the first marking engine is prepared for operation;

a second marking engine, said second marking engine selectively marking an output media during its operation and having a warm-up period associated therewith in which the second marking engine is prepared for operation; and, a power supply that selectively supplies electrical power to the first and second marking engines, said cower supply providing warm-up power to the marking engines during their respective warm-up periods to prepare them for operation, and providing operating power to the marking engines to power their operation;

wherein power from the power supply is selectively distributed to the first and second marking engines so that the first marking engine completes is warm-up period sooner than the second marking engine completing its warm-up period; and, wherein the warm-up period for the second marking engine begins at about a time when the warm-up period for the first marking engine ends.

11. The printing device of claim 10, wherein the marking engines are xerographic modules.

12. The printing device of claim 11, wherein the xerographic modules include fusers, and at least a portion of the warm-up power supplied to the marking engines is used to heat the fusers to an operating temperature.

* * * * *